US007235742B2

(12) United States Patent
Aochi et al.

(10) Patent No.: US 7,235,742 B2
(45) Date of Patent: Jun. 26, 2007

(54) CIRCUIT BOARD CONNECTOR

(75) Inventors: Akira Aochi, Nara (JP); Hiroyuki Homi, Shimonoseki (JP)

(73) Assignees: Sanyo Electric Co., Ltd., Moriguchi-shi (JP); Sanyo Tuner Industries Co., Ltd., Daito-shi (JP)

( * ) Notice: Subject to any disclaimer, the term of this patent is extended or adjusted under 35 U.S.C. 154(b) by 0 days.

(21) Appl. No.: 10/537,436

(22) PCT Filed: Dec. 3, 2003

(86) PCT No.: PCT/JP03/15497

§ 371 (c)(1),
(2), (4) Date: Jun. 3, 2005

(87) PCT Pub. No.: WO2004/051810

PCT Pub. Date: Jun. 17, 2004

(65) Prior Publication Data

US 2006/0011373 A1 Jan. 19, 2006

(30) Foreign Application Priority Data

Dec. 3, 2002 (JP) ..... 2002-350834

(51) Int. Cl.
*H01R 4/18* (2006.01)

(52) U.S. Cl. ..... 174/94 R
(58) Field of Classification Search ..... 174/94 R; 439/45, 75; 361/791
See application file for complete search history.

(56) References Cited

U.S. PATENT DOCUMENTS

| | | | | | |
|---|---|---|---|---|---|
| 3,764,955 | A * | 10/1973 | Ward | 439/377 |
| 3,897,992 | A * | 8/1975 | Weidler | 439/442 |
| 4,076,356 | A * | 2/1978 | Tamburro | 439/426 |
| 4,150,355 | A * | 4/1979 | Neff et al. | 338/332 |
| 4,401,352 | A * | 8/1983 | Heisey | 439/75 |
| 4,867,691 | A * | 9/1989 | Eck | 439/82 |
| 5,980,336 | A * | 11/1999 | Hall et al. | 439/843 |
| 6,305,949 | B1 * | 10/2001 | Okuyama et al. | 439/75 |
| 2003/0017735 | A1 * | 1/2003 | Singh | 439/329 |

FOREIGN PATENT DOCUMENTS

| | | |
|---|---|---|
| JP | 63-28529 | 8/1988 |
| JP | 05-121142 | 5/1993 |
| JP | 5-266936 | 10/1993 |
| JP | 58564/1994 | 8/1994 |
| JP | 2001-43914 | 2/2001 |
| JP | 2001-210442 | 8/2001 |

* cited by examiner

*Primary Examiner*—Chau N. Nguyen
(74) *Attorney, Agent, or Firm*—Armstrong, Kratz, Quintos, Hanson & Brooks, LLP

(57) ABSTRACT

A circuit board connector includes a main body portion, a first connecting portion for connection to a first circuit board, and a second connecting portion for connection to a second circuit board. The circuit board connector is obtained by cutting a conductive plate material provided with plating layers on front and back sides thereof, and thereafter forming the second connecting portion into a shape having an annular transverse cross section in such a manner that one of the plating layers forms an outer circumferential surface of the second connecting portion.

9 Claims, 9 Drawing Sheets

PRIOR ART

CIRCUIT BOARD CONNECTOR

BACKGROUND OF THE INVENTION

1. Field of the Invention

The present invention relates to circuit board connectors for connecting two circuit boards together.

2. Description of the Related Art

There are two types of circuit board connectors for connecting two circuit boards each other; one type is a socket housing type that can be dismantled even after product assembling and the other is a type that is fixed by soldering during product assembling. Among the latter type, which is fixed by soldering, the one as described below is known. This circuit board connector comprises, as illustrated in FIG. 13, a main body portion 2, a first connecting portion 1 for connection to a first circuit board, a second connecting portion 4 for connection to a second circuit board, and a lead portion 3 located between the second connecting portion 4 and the main body portion 2. The main body portion 2 comprises an auxiliary connecting portion 21 formed from a portion of the main body portion 2, so that the connecting strength is improved by making connection with the first circuit board at two points, at the first connecting portion 1 and the auxiliary connecting portion 21.

As illustrated in FIG. 14, when connected to a circuit board of an electronic apparatus such as a VTR, an electronic device 7 such as a tuner is arranged uprightly in order to reduce the mounting area of the circuit board. This necessitates the second connecting portion 4 to be drawn out from a narrow surface of the circuit board that is arranged, in the electronic device, parallel to a wide surface in the electronic apparatus, and therefore, the first connecting portion 1 and the auxiliary connecting portion 21 are bent when connected to a circuit board within the electronic device.

The outer shape of the above-described circuit board connector is, as illustrated in FIG. 15, formed by press cutting a single sheet of conductive plate material 5 the front and back sides of which have plating layers 6 of tin, nickel, or the like that have been formed thereon in advance. Thus, the transverse cross sections of the first connecting portion 1, the second connecting portion 4, and the auxiliary connecting portion 21 are formed to be rectangular.

However, cut surfaces 11 created by the press cutting are not provided with the plating layers and therefore have lower solder wettability than those in which a plating layer is formed on the entire surfaces. Moreover, there is a certain length of time until an electronic device equipped with the circuit board connector is shipped to the user and mounted onto a circuit board of an electronic apparatus. During that time, the second connecting portion of the circuit board connector is oxidized or rusted, and consequently a problem arises that solder wettability reduces.

In order to solve the foregoing problem, a method has been proposed in which re-plating is carried out for the circuit board connector after the press-cutting so that a plating layer is formed on the entire surface.

Re-plating the terminal, however, adds an extra manufacturing step and also increases cost. Moreover, the re-plating process usually adopts a barrel plating method, which involves putting samples to be plated into a barrel-shaped container containing a plating solution and revolving the barrel-shaped container, and in the course of this process, the terminals deform or get tangled, reducing the yield and leading to a further increase in cost. Furthermore, if a thin conductive plate material is used for cost reduction, the mechanical strength of the circuit board connector degrades, resulting in breakage during the manufacturing process and the mounting process to a circuit board, which also reduces the manufacturing yield.

The present invention has been accomplished to solve such problems, and it provides a circuit board connector with which good soldering is possible even without performing a re-plating process.

SUMMARY OF THE INVENTION

A circuit board connector of the present invention comprises a main body portion, a first connecting portion for connection to a first circuit board, and a second connecting portion for connection to a second circuit board; and the circuit board connector is obtained by cutting a conductive plate material provided with plating layers on front and back sides thereof, and thereafter forming the second connecting portion so as to have an annular transverse cross section in such a manner that one of the plating layers forms an outer circumferential surface of the second connecting portion.

In a circuit board connector of the present invention, cut surfaces at both edges of the second connecting portion oppose each other in addition to the foregoing configuration.

Moreover, in a circuit board connector of the present invention, a gap is provided between the cut surfaces at both edges of the second connecting portion that oppose each other.

In addition, a circuit board connector of the present invention is such that a circuit board connector comprising a first connecting portion for connection to a first circuit board and a second connecting portion connected to a second circuit board, wherein:

the circuit board connector is obtained by cutting a conductive plate material provided with plating layers on front and back sides, and thereafter forming the second connecting portion so as to have an annular transverse cross section and bending the second connecting portion so that cut surfaces are located inside the annular cross-sectional shape.

By allowing one of the plating layers of the second connecting portion to form the outer circumferential surface, solder wettability can be improved without performing an extra plating process. Moreover, by processing the second connecting portion so as to have an annular cross section, the mechanical strength of the circuit board connector can be improved, and therefore, a conductive plate material that is thinner than that in conventional products can be used; thereby, cost can be reduced.

Since the cut surfaces at both edges of the second connecting portion oppose each other, the cut surfaces, which are not plated, are not present in the outer circumferential surface; thus, solder wettability can be improved.

Moreover, by providing a gap between the cut surfaces at both edges of the second connecting portion, solder comes into the gap by capillary action, making it possible to improve solder wettability.

By forming the second connecting portion so as to have an annular transverse cross section and bending the second connecting portion so that the cut surfaces are located inside the annular shape, the cut surfaces that are not plated are kept away from the outer circumferential surface that is to be soldered. Therefore, rusting that develops on the cut surfaces over time does not easily reach the outer circumferential surface, making it possible to conduct good soldering.

DETAILED DESCRIPTION OF THE EXEMPLARY EMBODIMENTS

Figure 1:
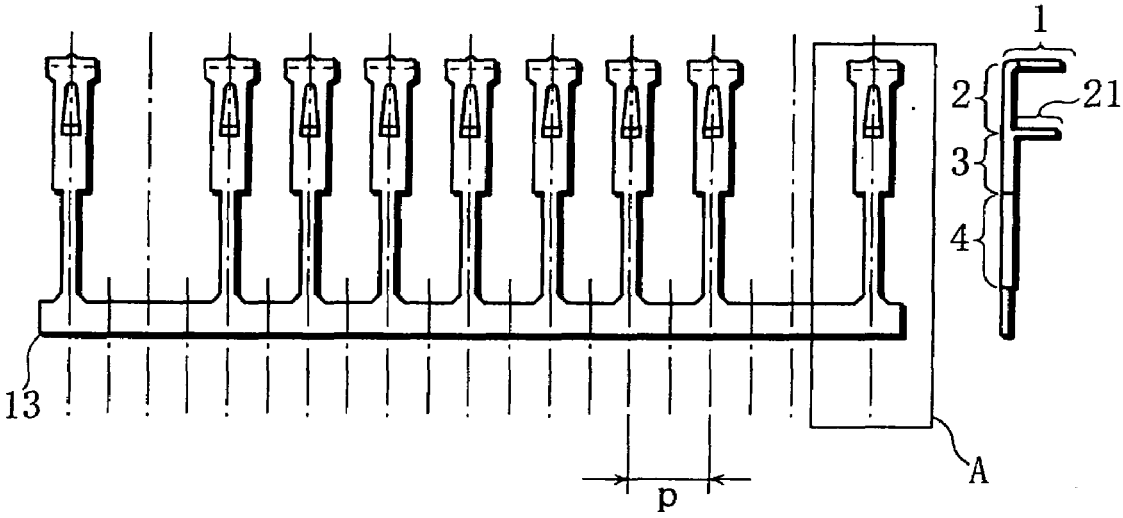
FIG. 1 shows a manufacture view and a side view of a circuit board connector according to an embodiment of the present invention.

A circuit board connector according to the present invention comprises a main body portion 2, a first connecting portion 1 for connection to a first circuit board in an electronic device, a second connecting portion 4 for connection to a second circuit board in an electronic apparatus, a lead portion 3 between the second connecting portion 4 and the main body portion 2, and an auxiliary connecting portion 21 formed from a part of the main body portion.

The circuit board connector of the present invention is formed by cutting a conductive plate material provided with plating layers on its front and back sides, and thereafter forming the second connecting portion into a shape having an annular cross section so that one of the plating layers forms the outer circumferential surface of the second connecting portion.

Figure 12A:
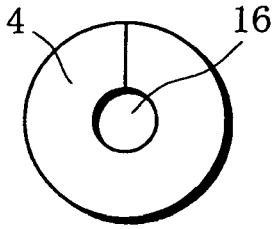
FIGS. 12A, 12B and 12C are transverse cross-sectional views of a second connecting portion in another embodiment of the present invention.
Figure 12B:
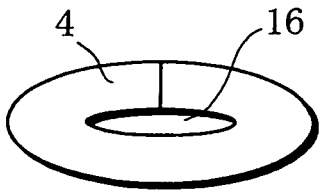
Figure 12C:
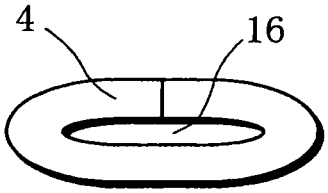
Figure 13:
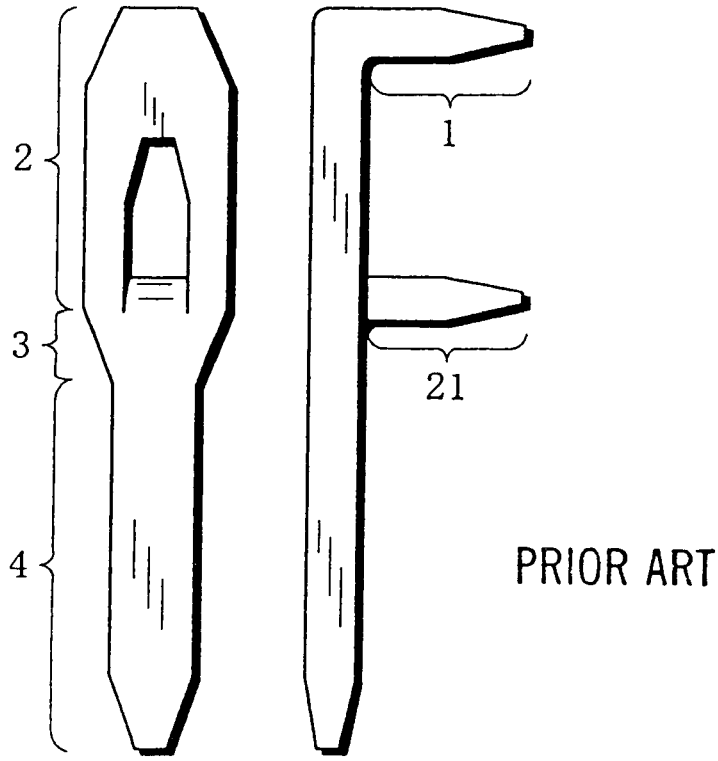
FIG. 13 is a front elevational view and a side view of a conventional press-formed type terminal.
Figure 14:
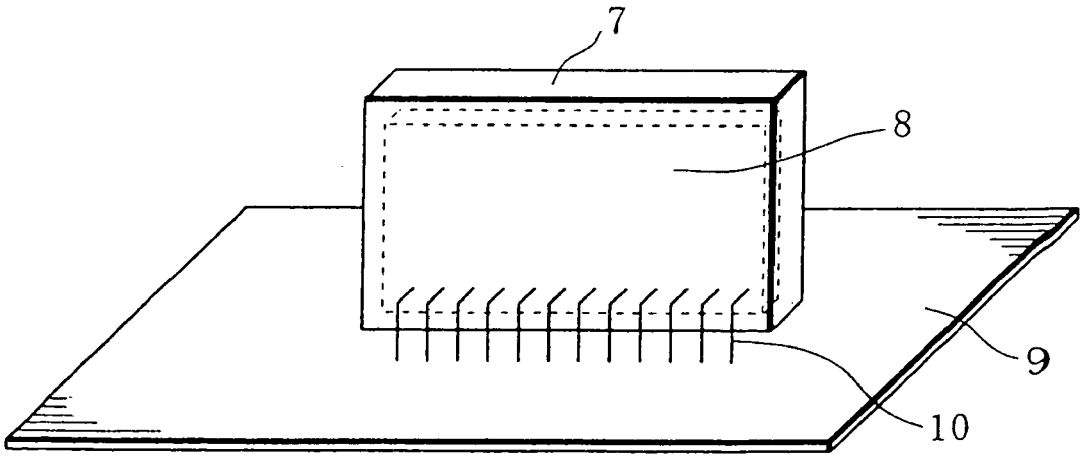
FIG. 14 is a view illustrating an arrangement of a first circuit board arranged on a second circuit board.
Figure 15:
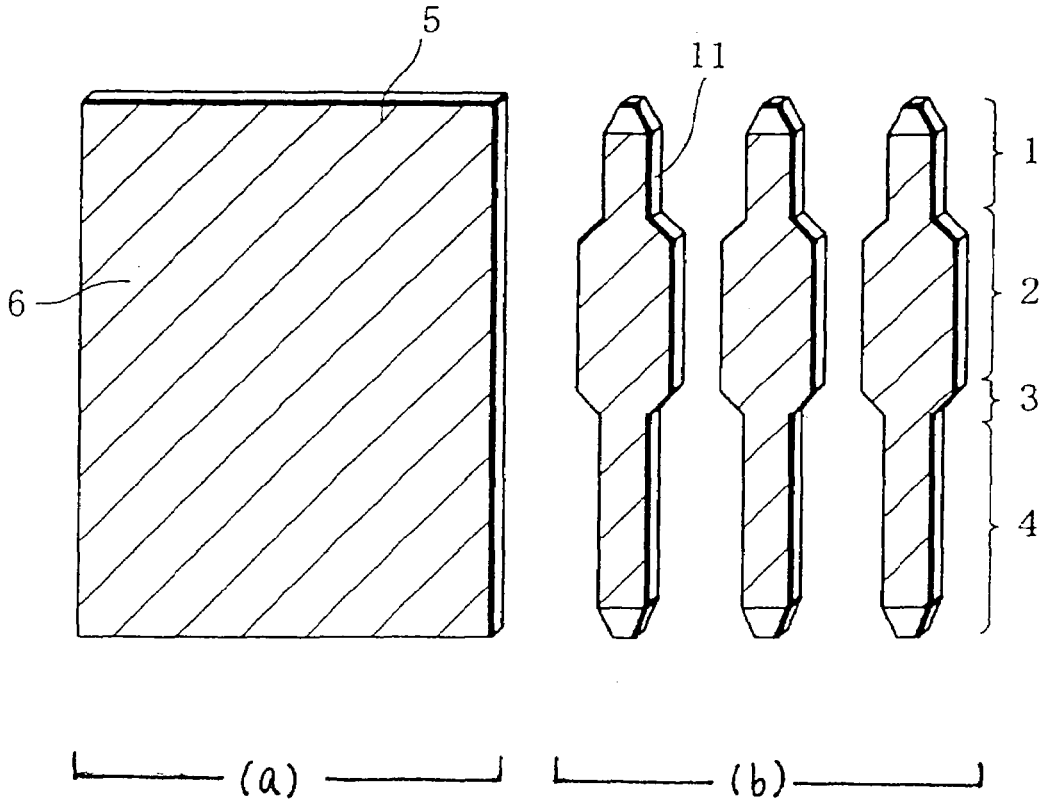
FIG. 15 is a perspective view showing a conventional conductive plate material (a) before a step of press-cutting and (b) after the step of press-cutting.

Herein, the term "annular shape" used in the present invention is intended to describe the shape that forms an inner hollow 16, and the outer shape is not particularly limited. Examples of annular cross-sectional shapes that may be adopted include, as illustrated in FIGS. 12A–12C, a circular shape (FIG. 12A), an elliptical shape (FIG. 12B), and an elongated elliptical shape (FIG. 12C). The outer shape may be changed as appropriate depending on the shape of the terminal sockets of the second connecting circuit.

There are no particular limitations on the plating layers used for the conductive plate material in the present invention as long as their materials have high electrical conductivity, and usable materials include gold, silver, copper, nickel, and palladium. In the following embodiments, a tin-plated conductive plate material was used.

The circuit board connector according to the present invention is fabricated as follows. As illustrated in FIG. 1, the outer shape of the circuit board connector was formed by press-cutting a conductive plate material 13, which was a steel plate or the like the front and back sides of which are provided with tin plating layers, so that the interval (P) between the terminals was 4 mm.

Figure 2:
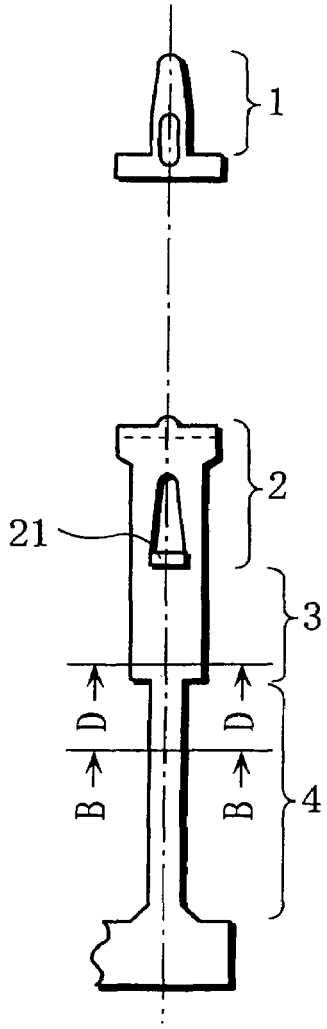
FIG. 2 shows an enlarged view of a portion A in FIG. 1 and a top view thereof.
Figure 3:
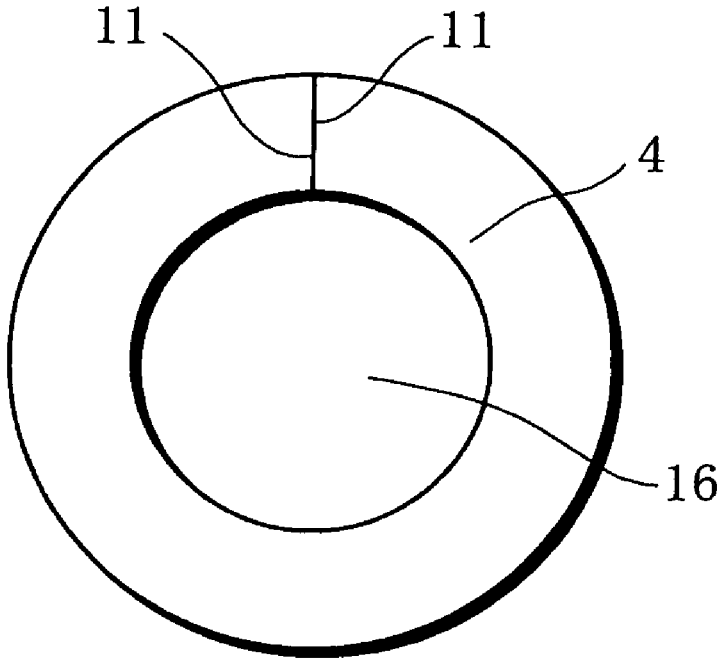
FIG. 3 is a cross-sectional view taken along the line B—B in FIG. 2.
Figure 4:
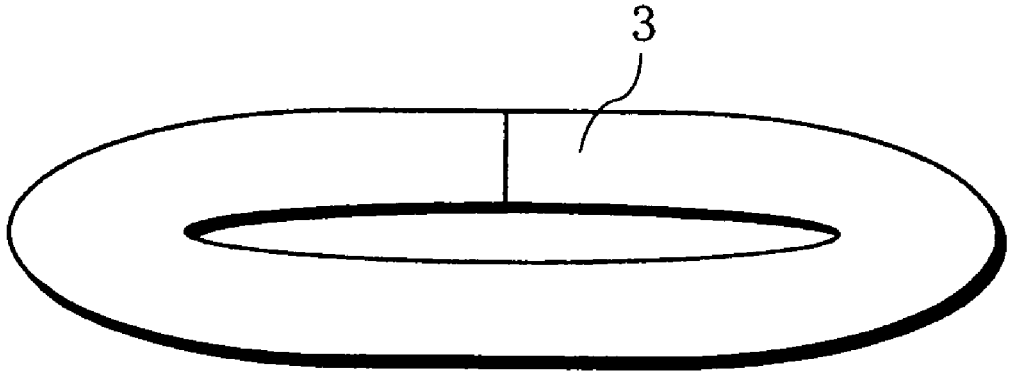
FIG. 4 is a cross-sectional view taken along the line D—D in FIG. 2.

Thereafter, as illustrated in FIG. 3, the cut surfaces 11 of the second connecting portion 4 were opposed so that one of the plating layers forms the outer circumferential surface of the second connecting portion, and thus the terminal was processed to have an annular cross section. Further, as illustrated in FIG. 4, the cut surfaces 11 of the lead portion 3 were opposed and the lead portion was processed to have an O-shaped transverse cross section, and thus, a circuit board connector as shown in FIG. 2 was completed.

In addition, because the second connecting portion 4 needed to be drawn out in a vertical direction from the circuit board arranged horizontally in the electronic device, the first connecting portion 1 and the auxiliary connecting portion 21 of the terminal were subjected to a bending process such as to be bent at right angles with respect to the second connecting portion.

Figure 5:
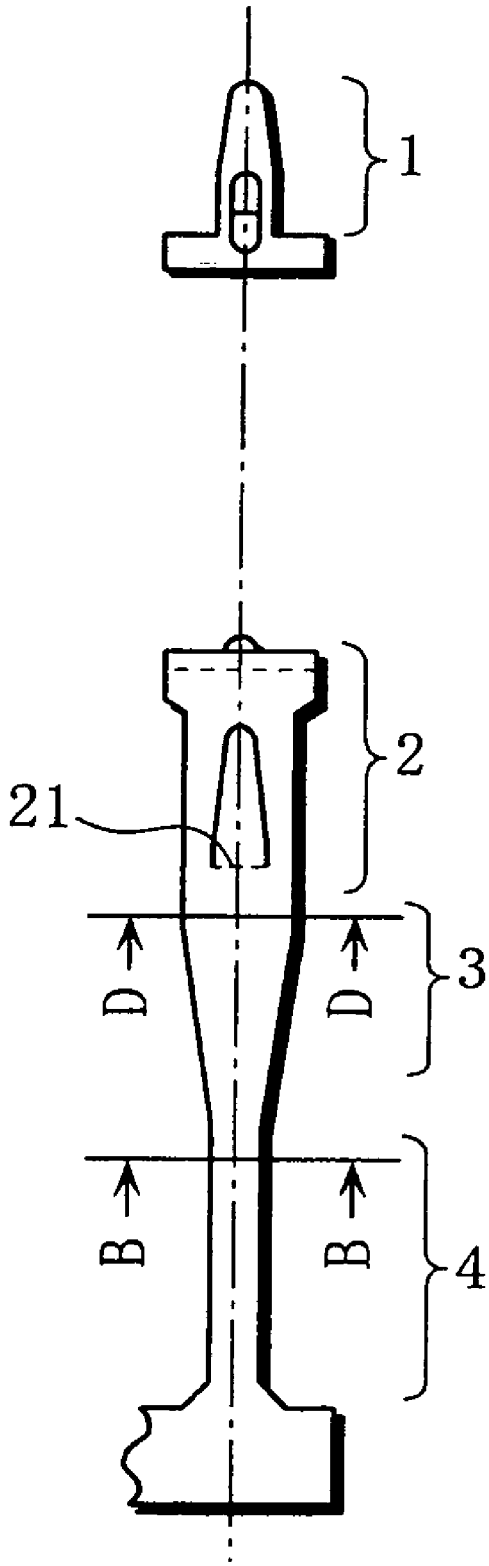
FIG. 5 shows a front elevational view of a circuit board connector according to a second embodiment and a top view thereof.
Figure 6:
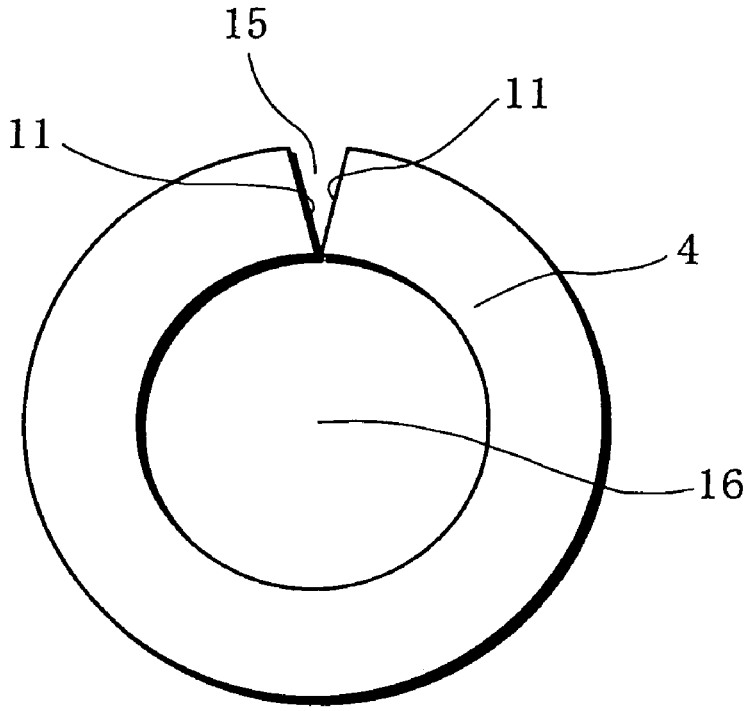
FIG. 6 is a cross-sectional view taken along the line B—B in FIG. 5.
Figure 7:
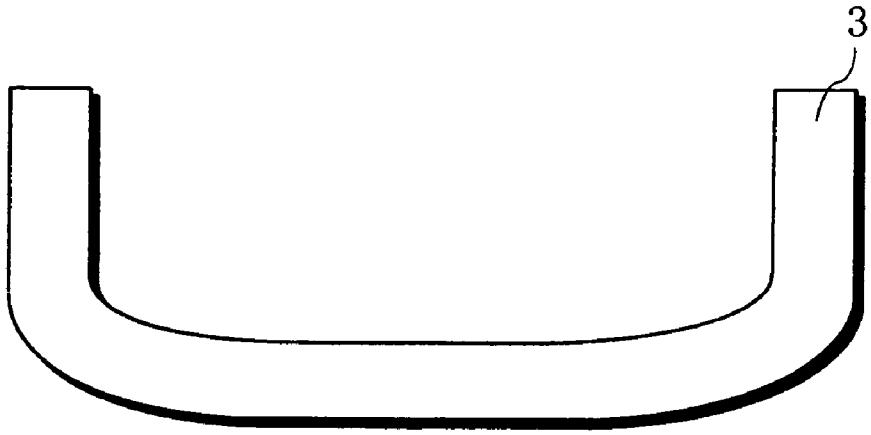
FIG. 7 is a cross-sectional view taken along the line D—D in FIG. 5.

FIG. 5 is a front elevational view and a top view illustrating a second embodiment of the circuit board connector according to the present invention. The second circuit board connector was obtained as follows: the outer shape of the circuit board connector was formed using press-cutting as in the first embodiment; thereafter, as illustrated in FIG. 6, a gap was provided such that cut surfaces 11 at both edges of the second connecting portion do not come into close contact with each other and that its cross section has a shape so that the plating layer forms the outer circumferential surface of the second connecting portion. Thereafter, the cut surface of the lead portion was processed into a C-shaped transverse cross section as illustrated in FIG. 7 for reinforcement, and thus a circuit board connector was completed.

Figure 8:
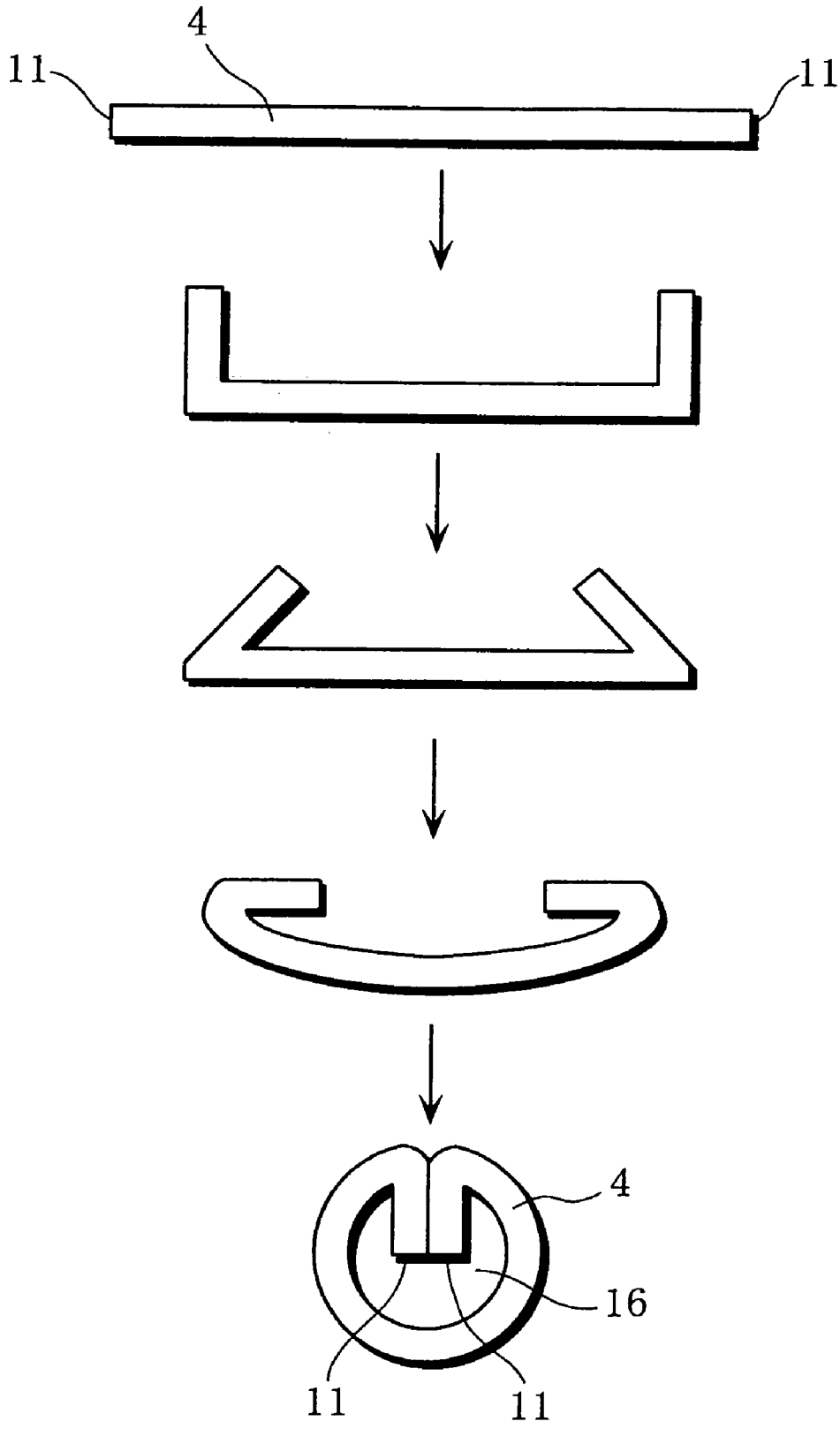
FIG. 8 is a cross-sectional view illustrating process steps of a second connecting portion in a third embodiment.

A circuit board connector of a third embodiment according to the present invention was obtained as follows. The outer shape was formed by press cutting a conductive plate material as in the first embodiment. Thereafter, the second connecting portion was processed as illustrated in FIG. 8 in the following manner. First, both ends of the second connecting portion near cut surfaces were bent at an acute angle, and thereafter, the second connecting portion was gradually processed through several manufacturing steps so as to have an annular cross section, so that the cut surfaces were brought inside the annular shape. Thereafter, the cut surface of the lead portion was processed into a C-shaped transverse cross section as illustrated in FIG. 7 for reinforcement, and thus a circuit board connector was completed.

In the above-described embodiments of the present invention, when the circuit board connector is in use, the first connecting portion 1 and the auxiliary connecting portion 21 are fixed onto the first circuit board by soldering and the second connecting portion 4 is fixed onto the second circuit board by soldering.

With the above-described configurations, the cut surfaces 11 of the conductive plate material 13 after the press-cutting are not present on the outer circumferential surface of the second connecting portion 4 of the terminal that is to be soldered, and therefore, solder wettability can be improved over conventional products.

Moreover, the terminal of the second embodiment is provided with a small gap between the cut surfaces 11 at both edges of the second connecting portion 4; therefore, solder comes into the gap by capillary action, making it possible to improve solder wettability.

Figure 9:
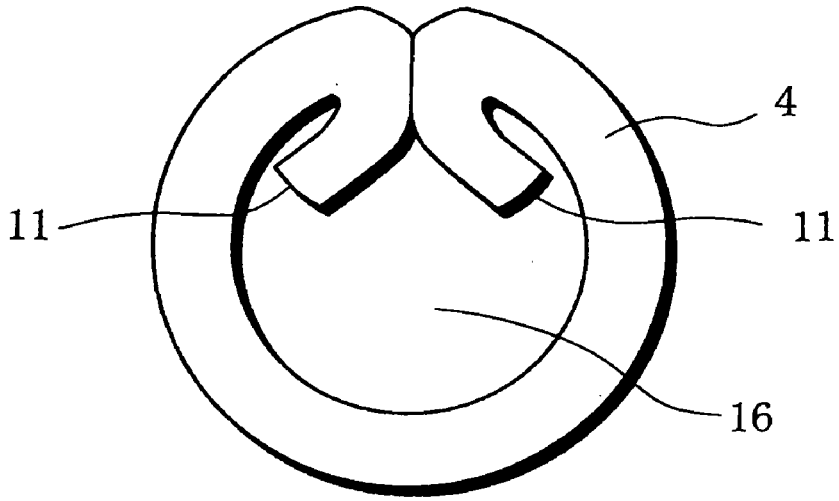
FIG. 9 is a cross-sectional view illustrating a second connecting portion in another embodiment.

Furthermore, the terminal of the third embodiment has the cut surfaces 11 of the second connecting portion 4 that are bent so as to come inside the annular shape, making it possible to keep the cut surfaces 11 that are not plated away from the outer circumferential surface that is to be soldered. Consequently, even when rusting develops on the cut surfaces 11 over time and corrosion due to the rusting reaches the plated surface, the rust does not easily reach the outer circumferential surface of the second connecting portion, and therefore, it is possible to conduct good soldering. To obtain this effect, it is sufficient that the cut surfaces come inside the annular shape, and for example, the same effect can be attained with a shape as illustrated in FIG. 9, in which the cut surfaces of the portion to be soldered of the second connecting portion are processed to be rounded to come inside the annular shape.

Figure 10:
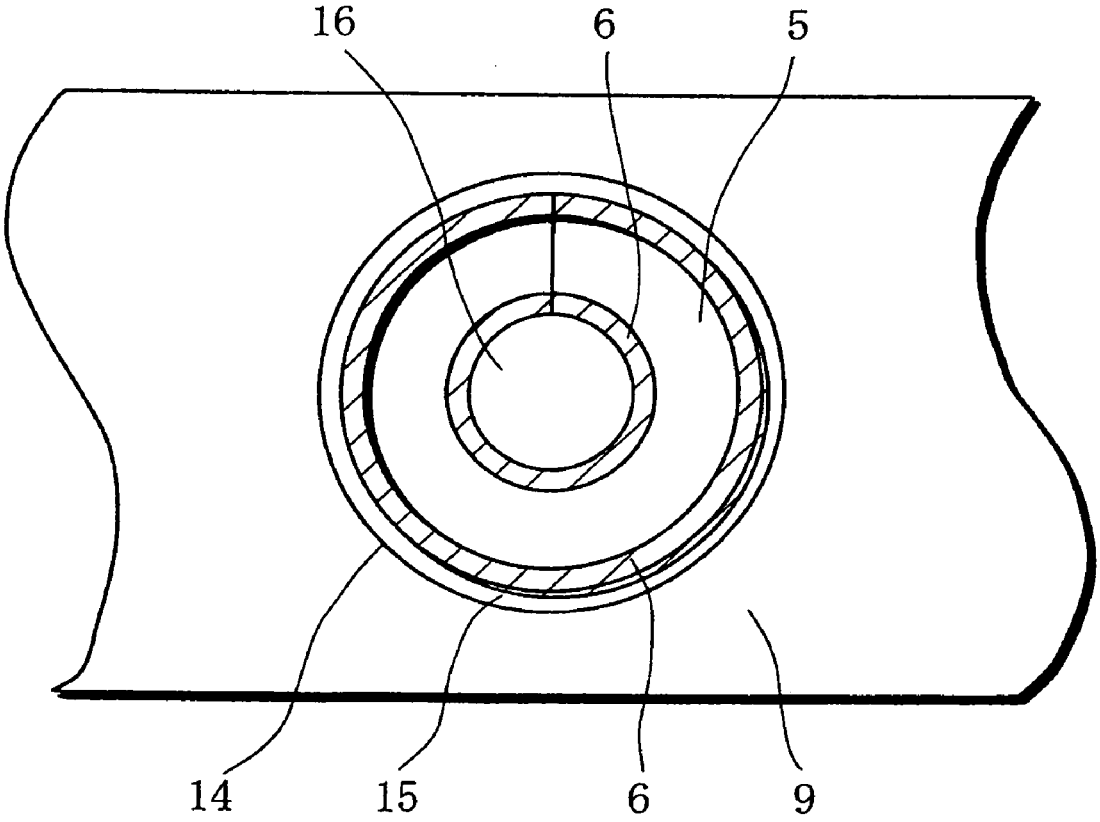
FIG. 10 is a cross-sectional view illustrating the state in which the second connecting portion of the first embodiment is inserted into a connecting socket of a circuit board.
Figure 11:
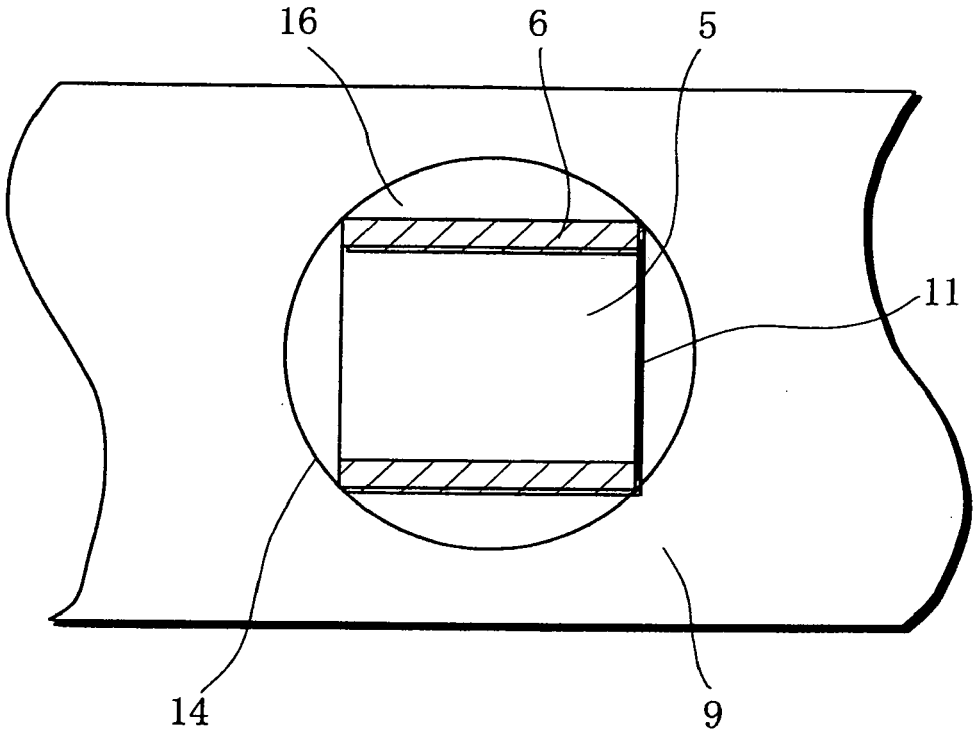
FIG. 11 is a cross-sectional view illustrating the state in which the second connecting portion of a conventional product is inserted into a connecting socket of a circuit board.

As illustrated in FIG. 11, when a conventional circuit board connector in which the portion to be soldered to a circuit board is rectangular is inserted into a circular terminal connecting socket 14 of a circuit board, the gap between the portion to be soldered and the circular terminal connecting socket is not uniform, producing distant portions; therefore, the connecting strength is weak. In contrast, the second connecting portion 4 of the terminal of the present invention is shaped to have an annular cross section, as illustrated in FIG. 10; therefore, the gap 15 to the circular terminal connecting socket 14 is uniform, making it possible to improve the connecting strength.

In addition, the terminal in which the second connecting portion 4 is formed to have an annular transverse cross section as in the embodiments can improve the mechanical strength of the second connecting portion over the conventional product that is not subjected to a bending process. For this reason, it is possible to use a conductive material that is thinner than that in conventional products, leading to cost reduction. Furthermore, the mechanical strength of the terminal can be further improved by applying a bending process an O-shaped or C-shaped cross section or the like to the lead portion, as in the embodiments.

The embodiments used one having an auxiliary connecting portion formed from a portion of the main body portion and the first connecting portion and the auxiliary connecting portion was bending-processed at right angles with respect to the second connecting portion; however, the number and shape of the first connecting portion(s) are not limited to the foregoing and may be varied within the scope of the claims.

When the first connecting portion of a terminal of the present invention as described above is used for an electronic device that is arranged uprightly, such as a tuner, it is possible to make effective use of the space on the circuit and to prevent occurrences of rusting and oxidation of the second connecting portion of the terminal. Consequently, good soldering can be conducted even when a certain time has elapsed after shipment of the electronic device until mounting of the electronic device onto an electronic apparatus.

INDUSTRIAL APPLICABILITY

With the circuit board connector of the present invention, good soldering is possible since a plating layer is formed on the outer circumferential surface of the second connecting portion. Moreover, it is possible to use a conductive plate material that is thinner than was conventionally possible because the mechanical strength of the second connecting portion is improved. Therefore, cost reduction can be achieved.

The invention claimed is:

1. A circuit board connector formed by cutting a conductive plate material provided with plating layers on front and back sides thereof, said circuit board connector comprising:

a main body portion;

a first connecting portion bent at a right angle to said main body portion for connection to a first circuit board;

a second connecting portion for connection to a terminal connecting socket of a second circuit board, the second connecting portion being positioned in the terminal connecting socket; and an auxiliary connecting portion formed from a portion of the main body portion and bent so as to be parallel to said first connecting portion, thereby leaving an opening in the main body portion, wherein the second connecting portion of the circuit board connector is formed into a shape having an annular transverse cross section in such a manner that cut surfaces at both edges of the second connecting portion oppose each other, so that one of the plating layers may form an outer circumferential surface of the second connecting portion and be connected to the terminal connecting socket, and wherein each of said plating layers is formed from one of gold, silver, copper, nickel, palladium and tin.

2. The circuit board connector according to claim 1, wherein a gap is provided between the cut surfaces at both edges of the second connecting portion that oppose each other.

3. The circuit board connector according to claim 2, wherein a lead portion is provided between the main portion and the second connecting portion, and the lead portion is subjected to a bending process for reinforcement.

4. The circuit board connector according to claim 3, wherein in the bending process the lead portion is formed to have an O-shaped or C-shaped transverse cross section.

5. A method of manufacturing an electronic apparatus, comprising: mounting an electronic device furnished with a first circuit board to which the first connecting portion of the circuit board connector according to claim 1 is connected, uprightly onto a second circuit substrate arranged in the electronic apparatus.

6. A circuit board connector, comprising a first connecting portion bent at a right angle to a main body portion of said connector for connection to a first circuit board and a second connecting portion connected to a second circuit board, wherein the circuit board connector is obtained by cutting a conductive plate material provided with plating layers on front and back sides, and thereafter forming the second connecting portion so as to have an annular transverse cross section and bending the second connecting portion so that cut surfaces are located inside the annular cross-sectional shape, wherein an auxiliary connecting portion is formed from a portion of said main body portion and is bent so as to be parallel to said first connecting portion, and wherein each of said plating layers is formed from one of gold, silver, copper, nickel, palladium and tin.

7. The circuit board connector according to claim 6, wherein the circuit board connector comprises a lead portion between the main body portion and the second connecting portion, and the lead portion is subjected to a bending process.

8. The circuit board connector according to claim 7, wherein in the bending process the lead portion is formed to have an O-shaped or C-shaped transverse cross section.

9. A method of manufacturing an electronic apparatus, comprising: mounting an electronic device furnished with a first circuit board to which the first connecting portion of the circuit board connector according to claim 6 is connected, uprightly onto a second circuit substrate arranged in the electronic apparatus.

* * * * *